United States Patent [19]

Davis

[11] Patent Number: 4,625,643

[45] Date of Patent: Dec. 2, 1986

[54] INK DISPENSING MEANS

[76] Inventor: William F. Davis, Mtd. Rte. 13 & Voelbel Rd., Hightstown, N.J. 08520

[21] Appl. No.: 639,212

[22] Filed: Aug. 9, 1984

[51] Int. Cl.[4] ..... B41F 31/08

[52] U.S. Cl. ..... 101/363; 101/169; 101/366

[58] Field of Search ..... 101/157, 169, 366, 363, 101/221

[56] References Cited

U.S. PATENT DOCUMENTS

| | | | |
|---|---|---|---|
| 3,205,816 | 9/1965 | Heimlicher | 101/366 |
| 3,298,305 | 1/1967 | Noon | 101/366 |
| 3,400,658 | 9/1968 | Gagliardi et al. | 101/366 X |
| 3,439,609 | 4/1969 | Dorr | 101/366 |
| 3,630,146 | 12/1971 | Shields | 101/366 X |
| 3,641,932 | 2/1972 | Behringer | 101/366 X |
| 3,796,155 | 3/1974 | Schluckebier | 101/366 X |
| 3,885,496 | 5/1975 | Breitweg et al. | 101/366 X |
| 4,085,672 | 4/1978 | Grosart | 101/366 X |
| 4,281,597 | 8/1981 | Dressler | 101/366 X |
| 4,461,211 | 7/1984 | Wesselmann et al. | 101/366 |

FOREIGN PATENT DOCUMENTS

| | | | |
|---|---|---|---|
| 2601340 | 7/1977 | Fed. Rep. of Germany | 101/366 |

*Primary Examiner*—Edgar S. Burr
*Assistant Examiner*—Moshe I. Cohen

[57] ABSTRACT

An anilox drum is provided with an ink applicator having a plenum chamber add flow control means. The applicator interfaces with the drum to form two orifices. Ink supplied under pressure to the applicator issues from the orifice to flush away boundary layer air and air in the ink cells; and the cells are filled with clean fresh ink. A doctor wipes the excess ink from the periphery of the drum and all excess ink is recirculated.

4 Claims, 5 Drawing Figures

INK DISPENSING MEANS

The present invention is concerned with ink dispensing utilizing anilox metering drums and more particularly it is concerned with ink dispensing in publication letter and lithographic printing presses.

BACKGROUND

Traditionally ink is applied to a roller in a thick film, modulated with a plurality of laterally disposed regulating means to desired thickness and then transferred sequentially to a large number of rollers to thin the ink film and attenuate it to a thickness suitable for application to the image [printing plate] to be printed.

Research work of the American Newspaper Publishers Association [ANPA] has demonstrated an anilox drum dispensing system will produce satisfactory inking of the image without the need of lateral regulating means and the plurality of rollers. Additional benefits are also realized.

An anilox drum is a cylindrical drum having its periphery populated with recessed cells which for publication printing are 11 to 19 microns, ie. 0.000429 to 0.000741 inches, in depth and have a population of 40,000 to 160,000 cells per square inch of the drum's periphery. The cells may have various shapes usually depending upon the processing method of forming the cells.

Universally, past and current practice of dispensing ink with an anilox drum is to immerse the drum in a body of ink to fill the cells with ink and to wipe the excess ink from the drum's periphery with a doctor as the drum is rotated, thus leaving only the ink in the cells for application to the image for printing.

This technique has been plagued with several problems when utilized for publication presses operating at 2000 to 3500 feet per minute surface speed.

Cells of the drum are not consistantly refilled with ink because when the ink is transferred from the cells it is replaced with air and the ink having a high surface tension bridges ove the cells when the cells are submerged in the body of ink. The result is unacceptable non-uniform and inconsistant print quality. U.S. Pat. No. 4,158,333 assigned to the ANPA represents one of many efforts to solve the problem.

Another problem is the ink having a high tack collects dust and fibres from the sheet being printed. This foreign material is transferred from the image to the anilox drum and cloggs cells, contaminates the ink supply and lodges at the interface of the doctor and the drum causing irregular wiping of the drum thereby producing streaking and unacceptable printing. Efforts to relieve this problem are to dilute the contaminated ink body in which the drum is immersed by recirculation and mixing with clean ink.

U.S. Pat. No. 4,373,443 asserts that anilox ink dispensing may be retrofitted to existing printing presses having conventional ink trains and dispensing equipment. While this is possible it is costly and requires taking the press out of production for extended periods of time to effect the retrofit.

Further, prior to the present invention arrangements were not applicable to color decks and color couples which have the printing cylinders located below the ink dispensing means. The inability to fully retrofit existing presses has circumvented the utilization of anilox ink dispensing.

SUMMARY OF THE INVENTION

Objects of the invention are to eliminate the limitations and problems of anilox ink dispensing with particular attention directed to publication printing presses.

An anilox drum is interfaced with an ink applicator having a plenum chamber and flow control means to form two orifices along the length of the drum. An ink supply pressurizes the plenum chamber which is proportioned to equalize the pressure within the chamber while the flow control means distributes the flow of ink uniformly across the length of the orifices.

Ink issuing from an orifice flushes away foreign matter and the boundary layer of air from the drum's periphery. The air in the ink cells is displaced with ink as the cells enter the plenum chamber. The second orifice acts to restrict the flow of ink from the applicator.

A doctor blade means is provided, spaced apart from the applicator, to wipe the periphery of the drum of ink leaving only ink in the ink cell to be transfered to an ink taking means.

Ink which issues from the orifices and is wiped from the drum is collected, filtered and recirculated as clean fresh ink to the applicator.

The entire ink dispensing system is contained within end walls which in retrofit applications may be supported on two cross beams fastened to the aisle side of the unit press frames thereby providing ease of access, servicing and installation without costly alterations to the press. Further, page wide modules permit rapid color change and positioning thereby providing the ability to place color on any page in the publication. In such applications the anilox drum is frictionally driven by the form roller of the printing press.

DESCRIPTION OF THE INVENTION

Figure 1:
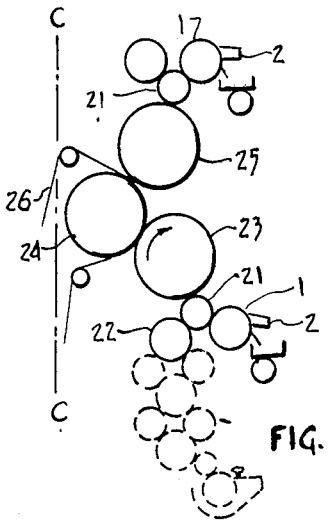
FIG. 1 is a diagrammatic illustration of the invention applied to one half of a newspaper arch type letter printing press.

FIG. 1 illustrates one half of an arch type newspaper printing unit, the unit being substantially symmetrical about the center line C—C wherein each half prints one side of the web 26. Impression cylinder 24 coacts with plate cylinders 23 and 25 each of which carries a printing plate having an image to be printed. The plate cylinder with its inking means is called a color deck and is used to print a second color on the web.

The rollers diagrammatically shown in dashed lines are elements of a conventional ink distributing train, and are not used in this invention.

Form roller 21 which is resiliently covered and roll 22 also are part of a conventional ink train and are employed to transfer ink from an anilox drum 1 to the image. The roller 21 is frictionally driven by the roll 22 and the anilox drum 1 in one preferred form of the invention is frictionally driven by the form roller 21.

Figure 3:
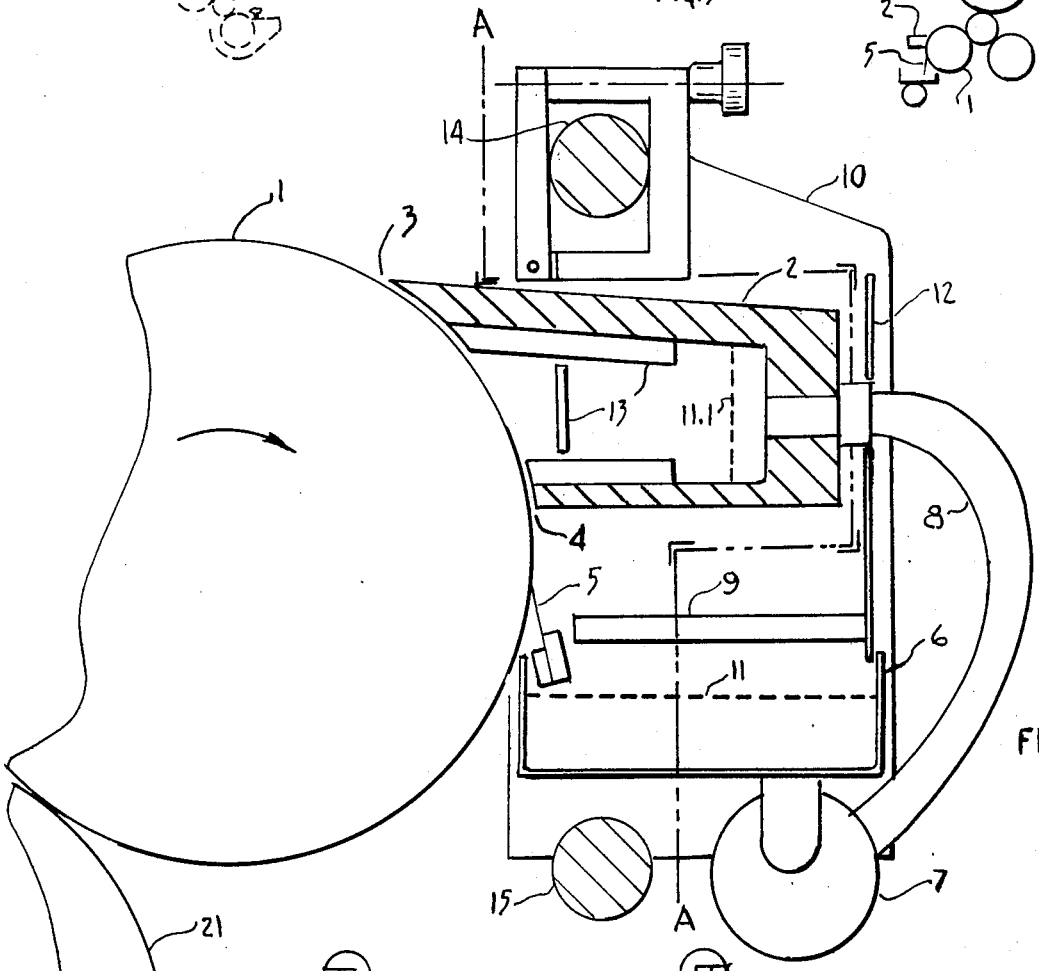
FIG. 3 is a diagrammatic cross section presentation of the invention.
Figure 4:
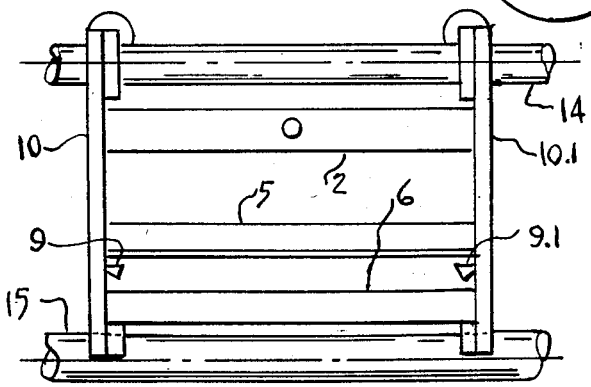
FIG. 4 is a view looking in the direction of the arrows A—A of the diagrammatic illustration of FIG. 3.

Now, referring to FIG. 3, an anilox drum 1 is provided with a doctor blade means 5 to wipe the periphery of the anilox drum clean of ink, and an ink applicator disposed before the doctor and after the form roller 21 which takes the dispensed ink from the anilox drum 1.

The ink applicator 2 is configured to have an open chamber with closed end and is interfaced with drum 1 to form a plenum chamber having two orifices along the length of the drum 1. The orifice 4 is sized to minimize the quantity of ink issuing therefrom.

An ink sump 6 is provided with a pump 7, preferably a centrifugal pump, to circulate ink from the sump 6 to the plenum chamber of the applicator 2. The plenum chamber is proportioned and sized to equalize the pressure in the ink in the chamber; and the chamber is fitted with flow control means 13 which directs and equalizes the flow of ink to and along the orifices. The flow control means may take several forms, it may be a plate with a contoured outer, or inner peripheral edge or it may consist of suitable ribbing within the chamber dividing and directing the ink flow.

As illustrated in the drawings the components of this ink dispensing means can readily be disposed on one side and close to the top of the anilox drum 1, thereby permiting the ink taking means to be located below the dispensing means.

It is this inherent benefit that permits the rapid retrofit of the invention on the aisle side of existing printing units and affords conveniences and ease of operation.

It is also this characteristic of the invention which permits application of anilox inking to color couples and color decks as schematically illustrated in FIG. 1. The ink dispensing means is shown executed with a portable page wide color module supported on two prismatic beams 14 & 15 disposed parallel to the ink taking means. The module's end walls are adapted for mounting on the beams 14 and 15 and for positioning anywhere along the length of the beams thus permitting the module to be slid to different page positions across the web, as well as utilizing a plurality of modules across the web width to print different page wide colors.

Figure 2:
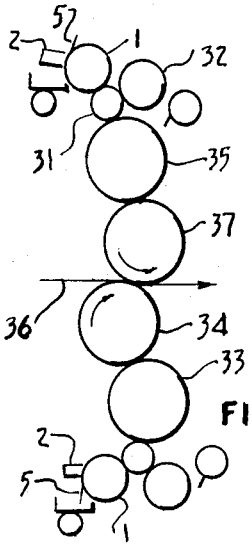
FIG. 2 is a illustration of the invention applied to a web offset lithographic printing unit.

FIG. 2 illustrates a vertical web (offset) lithographic printing unit in which 34 and 37 are blanket cylinders transferring the image from the plate cylinders 33 and 35 to the web 36. Directing attention to the upper cylinder arrangement 31 is a resiliently covered form roller and 32 is a driven drum adapted for receiving both ink from the anilox drum 1 and a water solution from the water solution applicator, which is shown as a brush flicking means but may be any of the well known devices.

Figure 5:
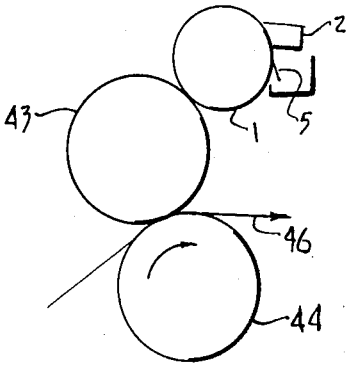
FIG. 5 is a diagrammatic illustration of the invention as utilized to directly ink the image, of a letter press, to be printed.

In FIG. 5 a printing couple is schematically shown where the plate cylinder 43 coacts with an impression cylinder 44 to transfer the image to web 46. The Ink dispensing means of this invention is shown applying ink directly to the printing plate.

OPERATION OF THE INVENTION

As the anilox drum 1 rotates from the ink taking means toward the applicator with air in the ink cells and possibly some foreign material on its periphery and approaches the orifice 3, the ink issuing from the orifice flushes away the foreign material and strips the boundary layer of air from the periphery of the drum, and simultaneously displaces the air in the ink cells, replacing the air with clean fresh ink under pressure. The orifice 4 restricts the undesired issuing of ink from the applicator and is spaced away from the doctoring means to permit the doctor to wipe the periphery of the anilox drum with a minimum of pressure to minimize wear of the anilox drum and of the doctor blade.

Ink issued from orifice 3 which may be contaminated and the ink issuing from orifice 4, and from the periphery of the drum by action of the doctor is directed to and collected in the sump 6 whence it is filtered so only clean ink is recirculated to the plenum chamber to fill the ink cells. The recirculation rate is in the order of 200 times the consumption rate of the ink.

I claim:

1. In a printing press having an ink taking means rotatably mounted and driven; and an ink dispensing means comprising an anilox drum having ink cells recessed in the periphery of said drum, said drum rotatably mounted between end walls;

said ink taking means taking ink from said anilox drum; and a doctoring means wiping ink from the periphery of the drum;

said doctoring means spaced apart from said ink taking means;

an improvement comprising, in combination, an ink applicator disposed after the ink taking means and before the doctoring means with said doctoring means spaced apart from said applicator;

said applicator interfacing with the drum to form a plenum chamber having a first and a second orifice along the length of the drum;

said first orifice disposed further from said doctoring means than said second orifice;

said second orifice formed to minimize the flow of ink issuing therefrom;

means for flushing air and foreign material from the drum's periphery and from said cells prior to said cells entering said plenum chamber including an ink sump and an ink circulating means supplying ink to the plenum chamber in sufficient quantity to issue from both orifices at full press operating speed, whence the air in the cells is replaced with clean fresh ink under pressure as the cells pass thru the plenum chamber;

said chamber proportioned to equalize the flow of ink to said orifices;

collecting means directing the ink issuing from the two orifices and the ink wiped from the periphery of the drum to the sump.

2. An improvement according to claim 1 where said ink taking means is a resiliently covered roller transferring ink from said anilox drum to an image to be printed; said roller frictionally driving said anilox drum.

3. An improvement according to claim 1 where said ink dispensing means, doctoring means and applicator are mounted in a module having end walls;

said end walls supported by two prismmatic beams disposed parallel to said ink taking means;

said end walls adapted for positioning said module at any position along the length of said beams.

4. An improvement according to claim 1 where said applicator and said doctor are disposed to one side of the anilox drum's periphery.

* * * * *